US006314971B1

(12) United States Patent
Schneider

(10) Patent No.: US 6,314,971 B1
(45) Date of Patent: Nov. 13, 2001

(54) DISPENSER FOR CLEANING PAPER

(75) Inventor: Albert Schneider, Ludwigshafen (DE)

(73) Assignee: Wellgo GmbH Werkzeuge und Spritzgussteile, Ludwigshafen (DE)

( * ) Notice: Subject to any disclaimer, the term of this patent is extended or adjusted under 35 U.S.C. 154(b) by 0 days.

(21) Appl. No.: 09/463,450

(22) PCT Filed: Jan. 16, 1998

(86) PCT No.: PCT/EP98/00215

§ 371 Date: Mar. 24, 2000

§ 102(e) Date: Mar. 24, 2000

(87) PCT Pub. No.: WO99/04677

PCT Pub. Date: Feb. 4, 1999

(30) Foreign Application Priority Data

Jul. 26, 1997 (WO) ..... PCT/EP97/4073

(51) Int. Cl.[7] ..... B08B 3/02

(52) U.S. Cl. ..... 134/56 R; 134/122 R; 134/44; 134/201; 68/205 R

(58) Field of Search ..... 134/64 R, 122 R, 134/56 R, 44, 201; 68/205 R

(56) References Cited

U.S. PATENT DOCUMENTS 5,356,480 * 10/1994 Melgeorge .
5,375,616 * 12/1994 Chen .
5,443,084 * 8/1995 Saleur .
5,829,278 * 11/1998 Koo .

FOREIGN PATENT DOCUMENTS 34 09 905 9/1985 (DE) .
34 12 069 10/1985 (DE) .
91 13 931 1/1992 (DE) .
1 370 633 10/1974 (GB) .

* cited by examiner

*Primary Examiner*—Frankie L. Stinson
(74) *Attorney, Agent, or Firm*—Foley & Lardner

(57) ABSTRACT

The invention concerns a cleaning paper dispenser, consisting of a box (6) and a support for the paper (2) roll (2), at least a spraying nozzle capable of being switched on, and which can be actuated by a motor during the forward progression of the paper for moisturising it, of a motor drive for moving the paper forward, and a reservoir (5) containing the moisturising agent. The drive for moving the paper forward comprises at least a cylinder (7) driven by a motor and a counter-element. Said cylinder (7) consists of a foam envelope (40). The space between said cylinder and the counter-element is located under the roll unwinding point, and the opening for removing the paper from the box is located substantially in vertical alignment with the space separating the cylinder from its counter-element. The force of pressure between the cylinder and the counter-element can be adjusted such that the paper located between them can be removed when the motor has stopped.

18 Claims, 7 Drawing Sheets

DISPENSER FOR CLEANING PAPER

The present invention relates to a dispenser for cleaning sheets which can be removed from the dispenser in a dry or moist state as required. These cleaning sheets are constituted, in particular, by toilet paper, paper for cleaning the udder prior to milking or else kitchen towels or baby wipes and the like.

The problem with such sheets is that paper which is stored in a moist state dries out and can then only be used to inadequate effect, if at all.

A further disadvantage is that, for example if toilet paper is stored in boxes, the necessary level to which hygiene is maintained is not ensured when it is removed, in particular in public conveniences or hotels.

DE 34 12 069 A1 and DE 34 09 905 A1 thus propose dispensers in which paper sheets can be drawn off from a roll, and moistening by virtue of disinfecting and cleaning liquids being sprayed on is carried out immediately prior to the required paper web being torn off. The paper may be advanced in this case by a motor-driven roller (DE 34 12 069 A1). More prior art is also found in GB 1,370,633, U.S. Pat. No. 5,375,616 and DE-U 91 13 931.

However, in the case of devices according to the prior art, there is the difficulty that the sprayed-on liquid (commercially available emulsions which may also have bactericidal components) causes the sheets to bond adhesively to installation parts of the dispenser and to jam, with the result that the dispensers cannot operate reliably.

Since the moistened paper tears more easily than dry paper, it is also difficult for the jammed paper to be removed, with the result that the dispensers have to be opened for this purpose.

Furthermore, the paper web in the dispensers according to the prior art presented is deflected to a considerable extent, which, in the case of sensitive paper, may result in the web tearing even in the dry state. In addition, it is not possible for sheets to be removed when the motor is at a standstill, see, for example, DE 34 12 069 A1.

The present invention thus has the set object of further developing dispensers of the type outlined in the introduction to the effect that these dispensers can function to better effect, i.e. that the moistened sheets do not adhere to installation parts and jamming is thus avoided, that no tear-promoting deflection is necessary, and that the action of being drawn into the motor-driven conveying is made considerably easier. Furthermore, the spray device is intended to be straightforward in mechanical terms and to allow commercially available parts to be used. Moreover, it is also intended to be possible to remove sheets when the motor is at a standstill. This is important, in particular, when the motor is fed by a battery which, by its very nature, has only a limited capacity.

This object is achieved by a dispenser for cleaning sheets which has the features of the main claim. Advantageous configurations are found in the subclaims.

The advantage of the embodiment according to the invention is that there is no contact between installation parts and either the web which is to be conveyed or the web which is being conveyed, i.e. above and beneath the conveying means, and there is no need either for any tear-promoting deflection. Since the roller nip is located beneath the unwinding point of the new roll, all that is required, when the start of the web is introduced, is for the latter to be let down until it is gripped by the driven roller. The design as a foam-encased shaft basically allows introduction into the roller nip without a threading-in operation, since the rough surface of the foam means that the pliable, coarse-textured surface of the sheet can be gripped very easily.

The mating element may be a second roller; it is preferably designed as a convex smooth nose, is arranged on the cover, e.g. as a bead, and can be pivoted downwards with the cover, with the result that the entire path taken by the paper is exposed once the cover has been opened.

The spray nozzle is in connection with a refillable or exchangeable storage container and a pump.

Using an eccentric as a drive for the spray device makes it possible to use commercially available pumping spray heads which produce a spray cone when they are pressed and take in liquid from the storage container during the spring-induced upward movement.

The cleaning sheet is removed directly beneath the roller and the mating element, spraying with liquid taking place between the removal and the roller or rollers. The removal opening of the housing may, in a known manner, be or have a tear-off edge.

In order to prevent folds from being formed by follow-on of the paper roll, it is proposed for said paper roll to be braked (slightly). For this purpose, use may be made of a pivotable second lever, which has a movable braking roller, which can be positioned against the paper roll, or the bearing means of the roll runs counter to a slight resistance.

The eccentric can be driven by the same motor, e.g. via a gear mechanism with appropriate transmission, as is used for actuating the drive roller. This ensures a very straightforward construction, but means that the paper which is removed is always moistened. It is thus also proposed to assign a dedicated motor to the eccentric, with the result that it is possible to remove either dry or moist paper. For this purpose, the housing has two switches; one sets both motors in operation and the second merely operates the motor for the roller drive.

The eccentric preferably has a plurality of, in particular two, mutually opposite cams, which thus accordingly press down the pumping spray head twice upon rotation through 360°, with the result that the rotational speed and thus the noise development are low.

The eccentric drive is designed in this case such that the moistening takes place uniformly, i.e. the spray frequency is adapted to the distance of the head from the paper and the advancement speed of the latter.

Since the spraying operation brings about a circular application, the resulting circular surfaces are made to overlap.

The container is preferably a removable adjustment container which, once the contents have been used up, is exchanged together with the pumping spray head. This has the essential advantage that it prevents the formation of germs within the spray device. For this purpose, the container is fixed in a releasable manner within the dispenser, it being possible for the mount to have, at the same time, a metal press key which can be swung onto the pumping spray head and on which the eccentric acts. Wear to the pumping spray head, which consists of plastic, caused by the eccentric sliding thereon is thus ruled out.

In order to ensure a vector which acts constantly in the vertical direction on the pumping spray head, and thus to rule out jamming of the head as a result of tilting, it is proposed to provide a resiliently mounted plunger between the head and the eccentric.

The cam may have a hexagon or the like for adjustment purposes, via which it can be rotated for the purpose of removing the container with the pumping head.

Furthermore, the exchange of the container may be facilitated in that the cam position of the eccentric is determined by a follower or the like and said eccentric is always stopped in the position in which the head is not pressed down.

Furthermore, a means of sensing the sheet end may be provided in the dispenser. According to the invention, this is an optical sensor which detects light reflected by the sheet. The housing region concealed by the sheet (paper) is colored black, with the result that light striking it is not reflected and triggers a corresponding signal.

In order, with very narrow dimensions of the housing, to prevent the paper web from yielding under the impulse of the spray mist, even if the web end is not secured, it is proposed to produce a counter-impulse of approximately the same size on the rear side with the aid of one or more symmetrically aligned nozzles or blowers which act in the opposite direction and discharge air or even spray liquid. In addition to preventing deflection, moistening on both sides also has the advantage that the liquid need no penetrate the paper in order to pass to the opposite side, with the result that it is also possible to use materials which reduced absorbency, overall less liquid has to be utilized and, in addition, more uniform moistening can be observed.

As has been indicated above, the spray nozzles may be located in the vicinity of the housing outlet. Since it is also possible for the paper to be moistened above the following severing location, it is also proposed for the paper advancement to be switched off at a time interval after the spraying operation, in order to ensure severing from the web in the dry region. This also makes it possible to achieve the situation where the roller is not moistened and there is thus no formation of germs.

The conveyed sheet web may also be severed automatically with the aid of cutters, it also being possible here, of course, for the web length to be adjusted individually.

A further possible way of ensuring that the moistened sheet is discharged without being affected by the spraying operation consists in providing a second pair of rollers beneath the first pair of rollers, in which case the cleaning liquid is then sprayed on between the first and second pair of rollers. It is possible in this case to provide, in the region of action of the spray device, an additional roller, which is preferably likewise provided with a foam covering.

Spraying preferably takes place in this case level with the spindle of the additional roller.

In order to create space for the spray device in this case, a mating roller is not to be provided in this region. Since, however, the additional roller makes automatic threading into the bottom roller nip more difficult, the invention proposes to provide, opposite the additional roller, guide brackets which widen in the upward direction into a drawing-in opening and press the sheet web against the roller in conveying direction, said sheet web then likewise being conveyed vertically downward into the second roller nip.

When one roller is pressed against the other roller, on the one hand the rollers may yield if relatively thick materials are being conveyed; on the other hand, this ensures defined contact-pressure forces even with fatigue of the foam material.

The foam material for the rollers advantageously has closed cells, with the result that, if the spray nozzles are arranged above rollers or in the event of indirect moistening by spraying onto the rollers and transfer of the liquid from the rollers onto the paper, said rollers cannot become saturated.

It is also proposed to expose the sheet (in particular one made of paper) to liquid such that a border remains dry on both sides. This may be approximately 2 cm in each case for toilet paper. In this case, although the moistening effect is maintained, the stability against tearing at the incorrect location is nevertheless increased to a considerable extent.

The sheet(/paper) rolls are usually wound up on cardboard tubes. Since these have different internal diameters, rolls which do not fit are difficult to center. According to the invention, it is thus, finally, proposed to push into both ends of the tubes, before mounting in the dispenser, shaft sections which have outer bearing journals and are provided with inner spreading elements which align the tubes and/or the rolls coaxially with the bearing journals.

The present invention will be explained in more detail, using two exemplary embodiments, with reference to the attached figures, in which.

Figure 1:
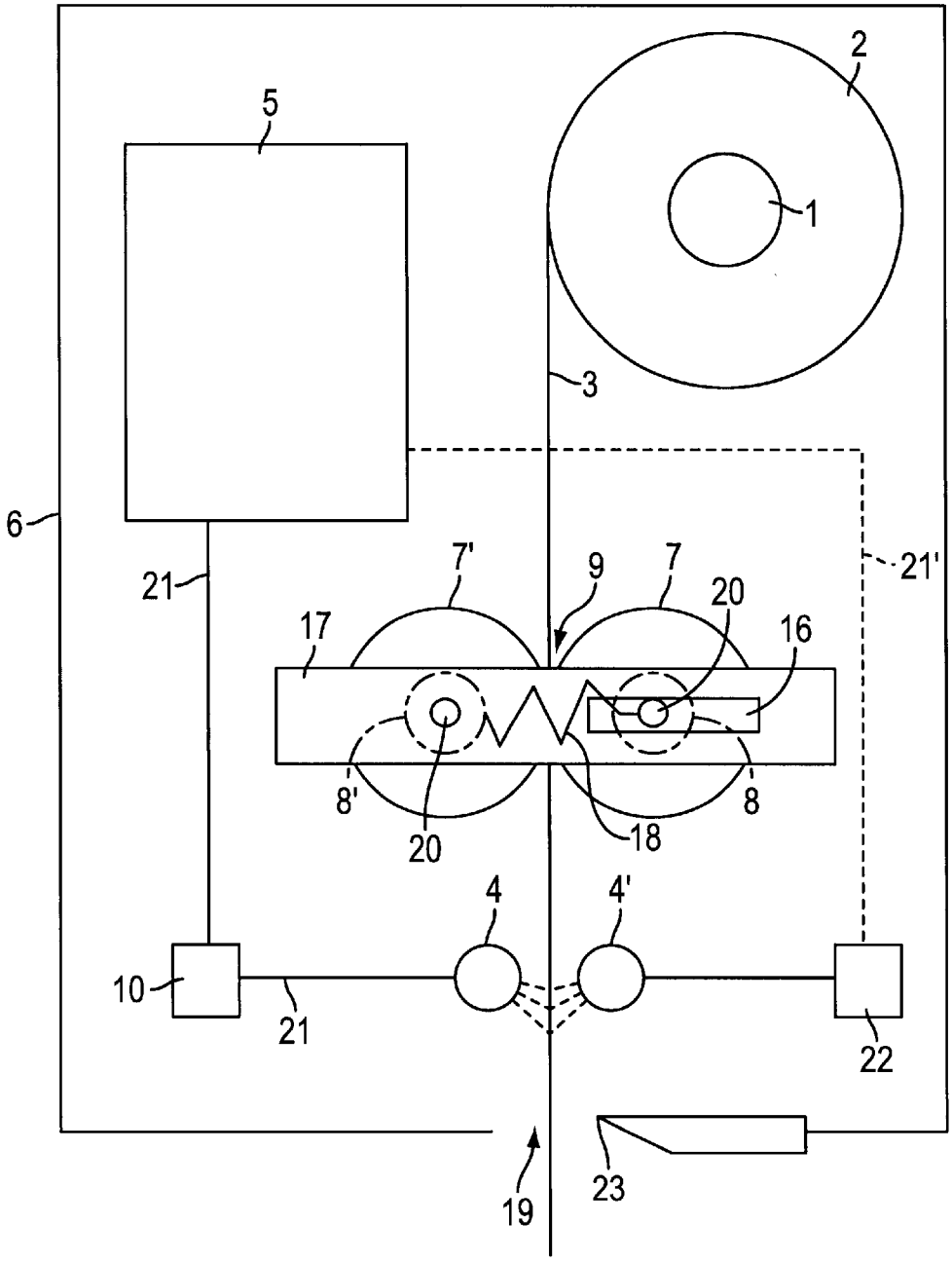
FIG. 1 shows an embodiment with one pair of rollers.

FIG. 1 illustrates schematically, with accommodation in a housing 6, the operation of conveying a paper web (toilet paper, udder-cleaning paper or the like) from the roll 2 to the removal opening 19. The roll 2 is located in this case on a mount 1, onto which it need merely be pushed. It is also possible for the mount 1 to be located above the housing 6, in which case the latter then has a slit.

Located preferably vertically beneath the unwinding point of the new roll 2 is a pair of rollers 7, 7' which is aligned with the paper web 3 and has rigid spindles 8, 8' onto which foam sleeves are drawn. By virtue of the alignment of the pair of rollers 7, 7', the nip 9 between the rollers is such that the web unwound from above can be gripped in a freely hanging state by the rollers 7, 7'.

If the roll 2 is arranged above the housing 6, the rollers are correspondingly located on the top housing border, which then has a slit into which the web of paper 3 has to be introduced by hand.

The rollers are mounted in a support framework 17 by means of journals 20 which extend into the same, one roller 7 being located in a slotted guide 16 and being forced against the opposite roller 7' by a spring (in this case tension spring) 18.

Located beneath the pair of rollers 7, 7' is a nozzle 4 which is directed (in an inclined manner) onto the paper web 3. It is in connection, by way of a line 21, with a storage container 5 with the liquid which is to be supplied. Of course, it is possible, in principle, for the moistening to take place directly via the foam rollers, in which case the latter then have the nozzle 4 acting on them.

The paper web passes under the force of gravity in a freely downwardly hanging state, into the removal opening 19, with the result that, over its entire path, the paper 3 is not deflected in any way.

In the removal opening 19 (or above the same with the aid of a cutter unit), the desired web length is severed from the top part in a dry or moistened state, for which purpose it is possible to use a severing edge 23 on the housing 6. The spray nozzle 4 may be arranged opposite an additional nozzle 4', which may be fed by the pump 10 or by another one, or else the nozzles 4' are part of a blower 22 in order to counteract the spray impulse of the nozzles 4.

The nozzles 4, 4' may in particular, as illustrated, be aligned in a downwardly inclined manner.

Figure 2:
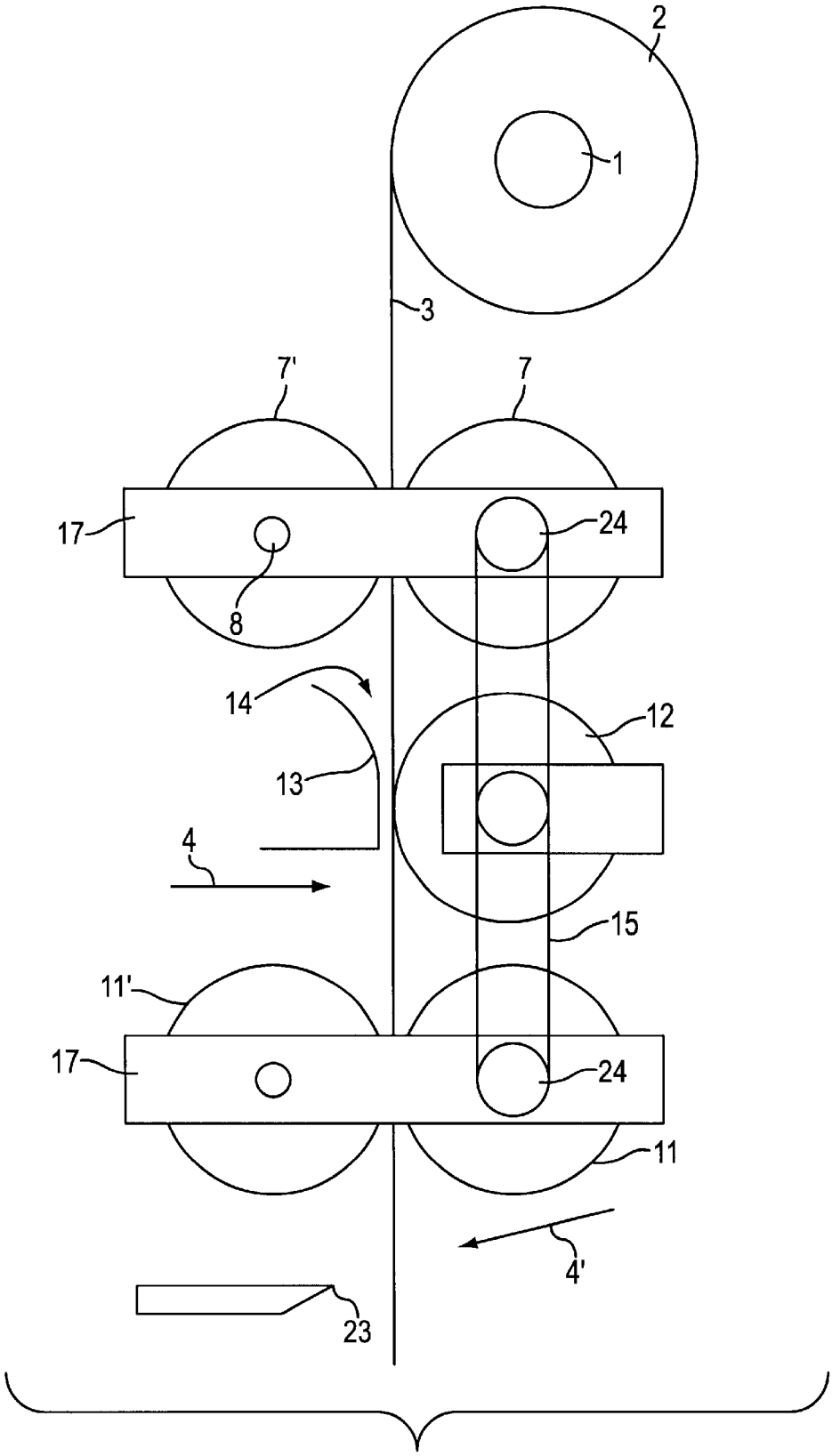
FIG. 2 shows such an embodiment with two pairs of rollers and an additional roller.

FIG. 2 shows the roll 2 on the carrier 1 and the paper web 3 unwound from said roll. Located beneath the first pair of rollers 7, 7', on the support framework 17, is an additional roller 12 and, opposite the latter, a pair of guide brackets 13, which are designed such that they widen upward. The spray nozzle or row of spray nozzles, indicated by an arrow 4, is located between the guide brackets 13, and the nozzles are directed, in particular, directly onto the additional roller 12, i.e. onto the spindle 8 thereof, but may also be located, as is shown, beneath the same or above the same.

Furthermore, the paper web 3 is guided by an additional pair of rollers 11, 11', which likewise grip, and guide, the paper on both sides. This means that the web cannot yield as a result of the spray impulse and adhere to parts of the apparatus, and the moistened web likewise passes into the region of the severing edge 23 in a vertically hanging state.

Of course, as in the above example, it is also possible for the moistening to take place, beneath the second pair of rollers 11, 11', via the nozzle 4' solely or additionally.

The rollers 7, 12, 11 of the right-hand row have gear wheels 24 and are connected to one another with the aid of a toothed belt, the spindle 8 of one of these rollers being driven by the electric motor (not illustrated).

Figure 3:
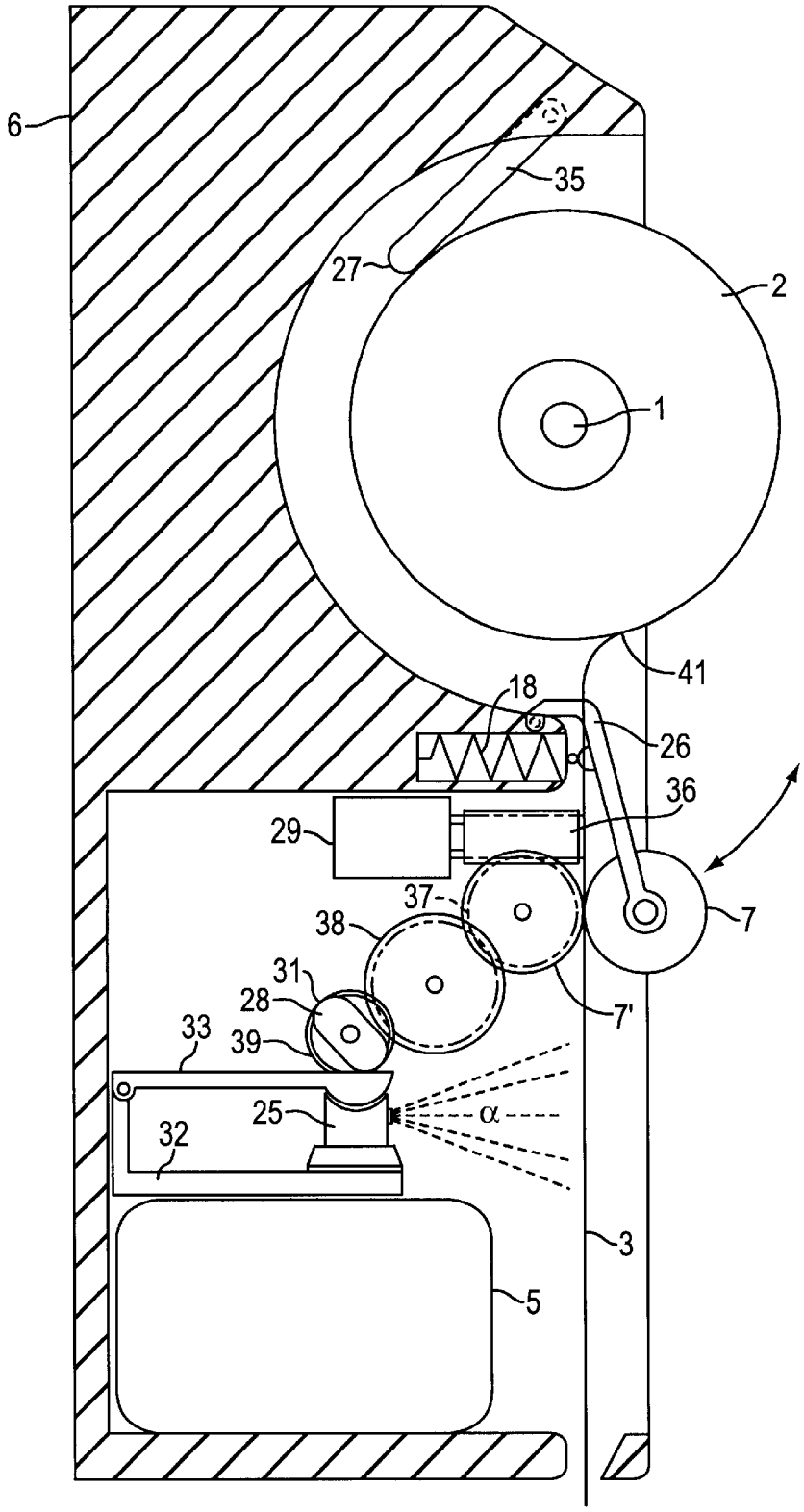
FIG. 3 shows an embodiment with an eccentric drive for the pumping spray head with one motor.

FIG. 3 shows the housing 6 with the paper roll 2 accommodated at the top of said housing. A brake 27 butts lightly against the roll 2 and prevents the roll 2 from over-rotating and prevents the paper from jamming as a result. The brake 27 is articulated at the top of the housing 6 via a second lever 35. The pair of rollers 7, 7' is located beneath the roll 2, the roller 7' being driven by an electric motor 29 via a worm 36 and a gear wheel 37. The eccentric wheel 39 with the eccentric 28, which in this case has two mutually opposite cams 31, is driven via said gear wheel directly or via an intermediate wheel 38.

Provided on the housing wall is a mount 32 for an adjustable storage container 5, and provided above the latter is a swing-down press key 33 which can be positioned on the pumping spray head 25 connected to the storage container, the eccentric 28 acting on said pumping spray head indirectly via the press key 33.

Positioned above the motor 29 is a first lever 26, which bears the roller 7. The lever 26 is connected to the spring 18. This allows the roller 7 to be pivoted away when required; once it has been released, the spring 18 draws the freely running roller 7 against the motor-driven roller 7'. The gear mechanism 37, 38, 39 is coordinated such that the spray cone, with the cone angle, moistens the paper 3 without any gaps being left.

This figure also illustrates that, as a result of the layers of the paper roll adhering to one another and with the correspondingly adjusted resistance by the brake, in the case of a vertical drawing-off operation, the unwinding point 41 of paper rolls is located approximately vertically beneath the roll axis. The invention exploits this, i.e. the roll mount 1 is likewise located vertically above the nip between the roller 7' and the mating element 7.

Figure 4:
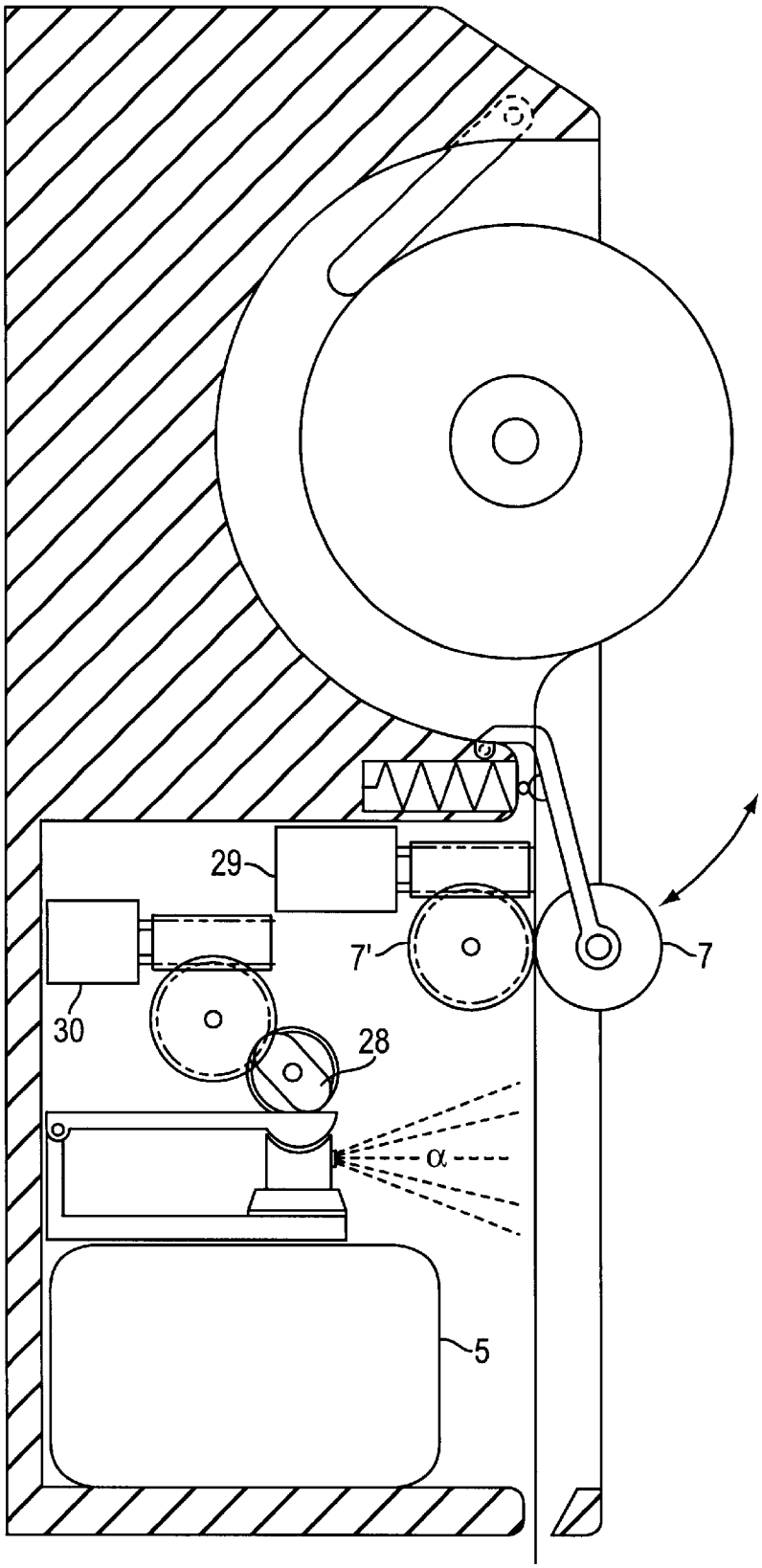
FIG. 4 shows a version with two motors.

FIG. 4 shows a design like that in FIG. 3, although in this case in addition to the motor 29, which drives the roller 7', a second motor 30 is provided for driving the eccentric 28. This very straightforwardly makes it possible for both dry and moistened paper to be removed.

Located for this purpose on the housing 6 are two switches (not illustrated) which preferably act in a contactless manner and of which one sets both the motor 29 and the motor 30 in operation and the other merely drives the motor 29 for the roller 7'.

Figure 5:
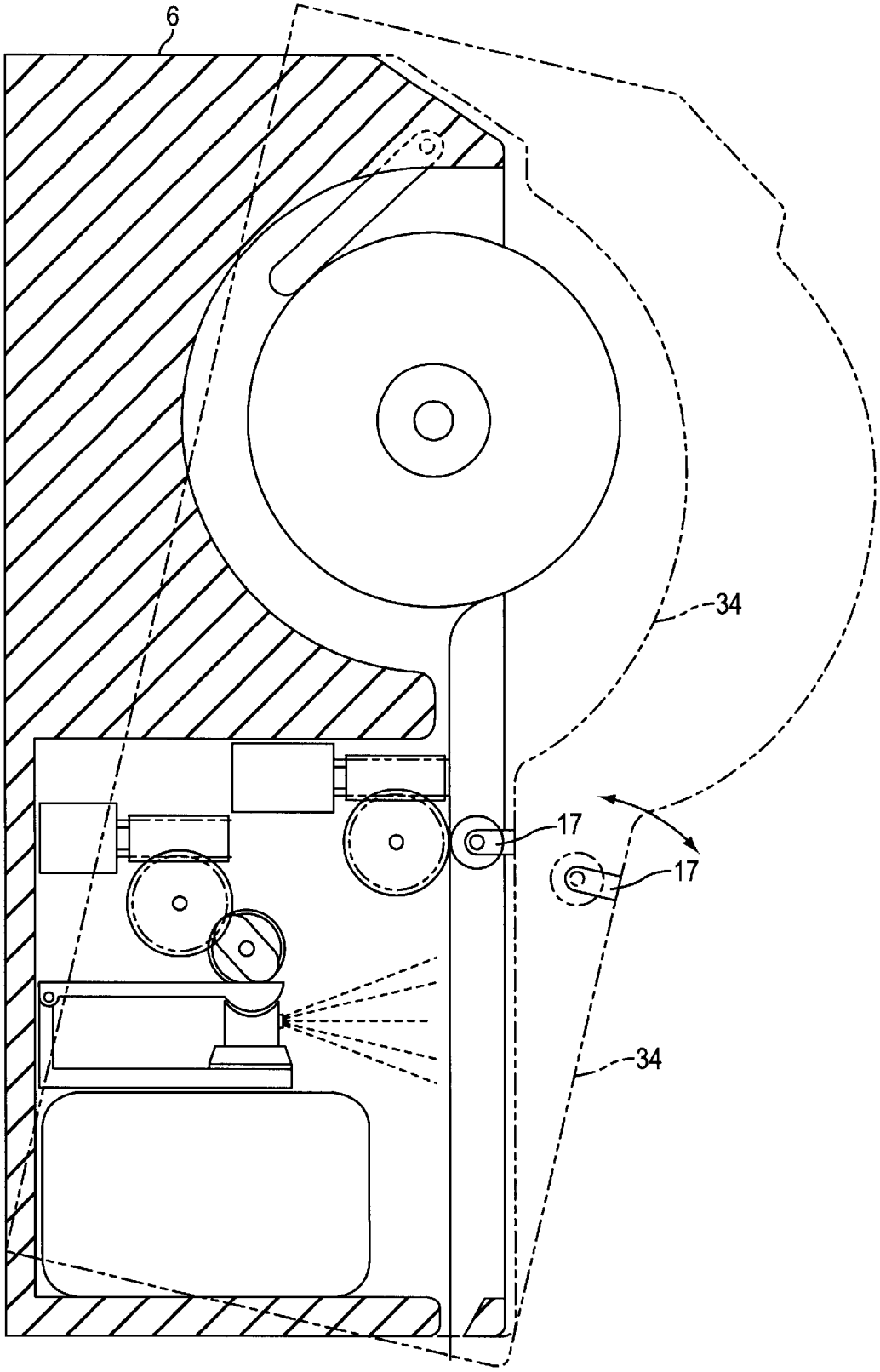
FIG. 5 shows a design with a swing-action cover.

FIG. 5 shows a version with a swing-action cover 34 on the front of the housing 6. Said cover can be pivoted away downwards to a great extent, whereupon all the parts of the dispenser are exposed. The mating roller 7 is provided, as mating element, on the cover 34 and may be mounted resiliently in its support framework 17.

Figure 6:
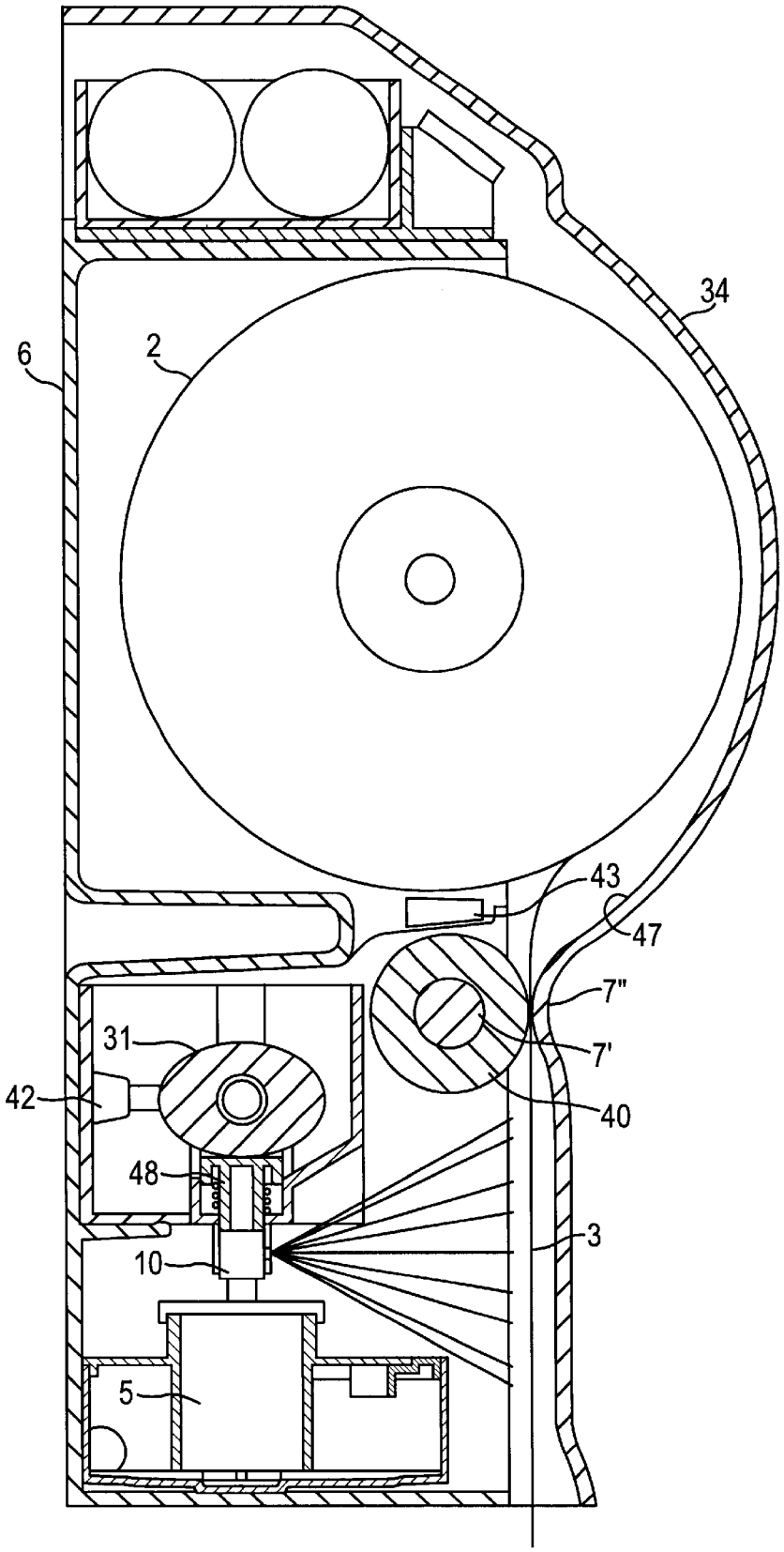
FIG. 6 shows the embodiment with a nose as mating element.

FIG. 6 shows the preferred embodiment of the present invention, in which the cover 34 is attached at the top and can be drawn off from the housing 6 or pivoted upward (not shown). Once the cover has been removed, the entire path taken by the paper 3 is exposed, which obviously facilitates refilling. In the present case, the mating element is a nose 7" which is formed in the cover 34 and is of the same length as that of the roller 7', the nose being smooth or bearing a smooth covering. The radius of the curvature of the nose here corresponds approximately to the radius of the roller 7'. Surprisingly, the operation of drawing out the paper 3 when the roller 7' is at a standstill is not obstructed as a result; said paper, with the correspondingly low contact-pressure force of the foam sleeve 40, slides easily therebetween. It can be seen that, in this case, only very low forces are necessary in order to convey the paper; the moistened paper hangs freely. The moistening method proposed according to the invention, in which a border is left free on both sides (approximately 2 cm for toilet paper) also allows the paper to be easily torn off at a severing edge (FIG. 3), for which purpose the resistance between the stationary roller 7' and mating element 7" (and also 7, e.g. FIG. 3) may likewise be coordinated therewith. Arranged above the nip between roller 7' and mating element (nose 7") is an optical sensor 43 which directs a light beam onto the paper 3 and detects reflected light. Located opposite the paper, for this purpose, is a matt black coloration 47 from which, once the paper 3 has passed, light is not reflected, in order for it thus to be possible for the advancement and drive of the cam 31 for the pumping spray head 10; 4 to be switched off immediately and thus moistening and contamination of housing parts (cover) to be avoided reliably. The drive for the pump is likewise modified in the present figure. Located beneath the cam 31 is a resiliently mounted and laterally guided plunger 42 [sic] which ensures that the vector acting at the top of the pump 10 is always directed vertically onto the top of said pump, with the result that the latter cannot tilt.

The cam 31 is also assigned a follower 42, which ensures that the motor is switched off such that the cam 31 remains in the position shown, in which the top of the pump 10 is not subjected to loading. This is advantageous for the removal of the storage container since this operation can then take place without force being exerted.

Figure 7:
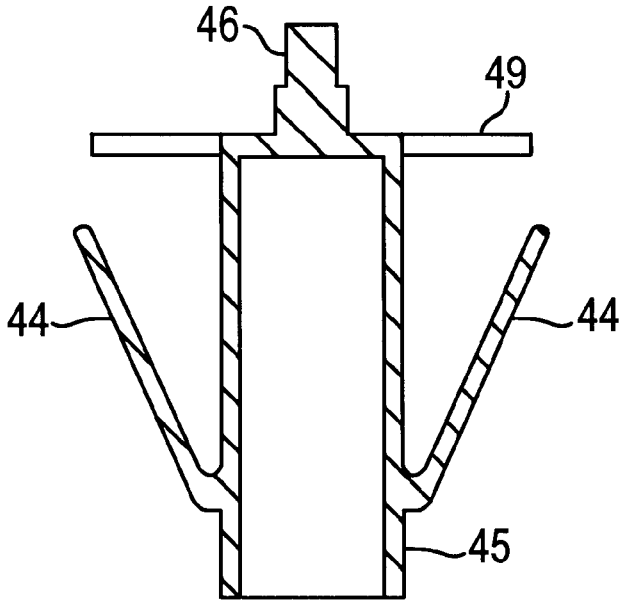
FIG. 7 shows the centering journals for the sheet-retaining tube.

FIG. 7 shows a shaft section 45 with spreading elements 44 projecting therefrom and with a stop 49 and a bearing journal 46 at the end. Two such shaft sections 45 are pushed into both ends of the cardboard tube of sheet (paper) rolls, the spreading elements 44 centering the tube. This makes it reliably possible for the supply rolls 2, even with the tubes having different inside widths, being fastened in the dispenser such that they run round. It is also possible for the shaft sections to interengage in order to produce a rigid connection.

LIST OF DESIGNATIONS

| List of designations | |
|---|---|
| 1 | Mount |
| 2 | Rolls |
| 3 | Paper |
| 4, 4' | Spray nozzle |
| 5 | Storage container |
| 6 | Housing |
| 7, 7' | Rollers |
| 7 | Nose |
| 8, 8' | Rigid spindles |
| 9 | Nip |
| 10 | Pump |
| 11,11' | Second pair of rollers |
| 12 | Additional roller |
| 13 | Guide bracket |
| 14 | Drawing-in opening |
| 15 | Toothed belt |
| 16 | Slits |
| 17 | Support frameworks |
| 18 | Spring |
| 19 | Removal opening |
| 20 | Journal |
| 21 | Line |
| 22 | Blower |
| 23 | Severing edge |
| 24 | Gear wheels |
| 25 | Pumping spray head |
| 27 | Brake |
| 28 | Eccentric |
| 29 | Motor |
| 30 | Second motor |
| 31 | Cam |
| 32 | Mount |
| 33 | Press key |
| 34 | Cover |
| 35 | Second lever |
| 36 | Worm |
| 37 | Gear wheel |
| 38 | Intermediate wheel |
| 39 | Eccentric wheel |
| 40 | Sleeve |
| 41 | Unwinding point |
| 42 | Follower |
| 43 | Sensor |
| 44 | Spreading elements |
| 45 | Shaft sections |
| 46 | Position [sic] journals |
| 47 | Black coloration |
| 48 | Flunger |
| 49 | Stop |

What is claimed is:

1. Dispenser for cleaning sheets, in particular toilet paper, kitchen-towel paper or udder-cleaning paper, comprising a housing (6) with cover (34) as well as a mount (1) for the paper (3), which is supplied on rolls (2), also comprising at least one switch-on spray nozzle (4) which can be motor-actuated upon advancement of the sheet in order to moisten the paper (3), and further comprising a motor drive for conveying the paper (3) as well as a storage container (5) for the moistening agent and a housing (6), the drive for conveying the sheet (3) comprising at least one motor-driven roller (7') and a mating element (7, 7"), characterized by the following features:

a) the roller (7') comprises a pliable sleeve (40) which is produced, in particular, from foam and is drawn onto a rigid spindle (8);

b) the nip (9) between the roller (7') and the mating element (7, 7") is arranged beneath the unwinding point (41) of the roll (2);

c) the removal opening (19) of the housing (6) is located essentially vertically beneath the nip (9) between the roller (7') and its mating element (7, 7");

d) the contact-pressure force between the roller (7') and the mating element (7, 7") can be adjusted such that the sheet (3) between them can be drawn out by hand when the motor (29) is at a standstill;

e) the nozzle (4) is arranged beneath the roller (7') and the mating element (7, 7").

2. Dispenser according to claim 1, characterized in that the mating element is a freely rotating mating roller (7) arranged on the housing cover (34) or a smooth or smoothed nose (7") which is designed such that it can be pivoted with said housing cover and is of approximately the same width as the roller (7').

3. Dispenser according to claim 2, characterized in that the nose (7") is formed in the housing cover (34).

4. Dispenser according to claim 1, characterized in that the roll (2) is braked or a brake (27) can be positioned against it.

5. Dispenser according to claim 1, characterized in that the storage container has a pumping spray head (25) which can be actuated by being pressed down and by a motor-driven eccentric (28).

6. Dispenser according to claim 5, characterized in that the eccentric (28) is driven by the same motor (29) as the drive roller (7').

7. Dispenser according to claim 5, characterized in that the eccentric (28) has a plurality of cams (31).

8. Dispenser according to claim 5, characterized in that a resiliently mounted plunger (48) is arranged between the eccentric (28) and the pumping spray head (25).

9. Dispenser according to claim 1, characterized in that the eccentric (28) is assigned a follower (42) by means of which the motor which drives the eccentric is stopped in a position in which the pumping head (25) is not subjected to loading.

10. Dispenser according to claim 1, characterized in that the spray cone of the spray head (25) is adjusted for the sheet (3) such that a non-moistened border remains on both sides.

11. Dispenser according to claim 1, characterized in that the container (5) is connected to the pumping spray head (25) and can be removed from the device together with the same.

12. Dispenser according to claim 1, characterized in that the container (5) is fixed by a mount (32) which is provided with a press key (33) which can be positioned on the pumping spray head (25) and via which the eccentric (28) acts on the pumping spray head (25).

13. Dispenser according to claim 1, characterized in that the follow-on of the paper drive is such that the roller (7') remains dry once the paper (3) has been moistened.

14. Dispenser according to claim 1, characterized in that it has a means of sensing the sheet end.

15. Dispenser according to claim 14, characterized in that said sensing means is an optical sensor (43) which detects light reflected by the sheet (3), that region which is located opposite the sensor, behind the sheet (3), being colored black.

16. Dispenser according to claim 1, characterized in that the sheet roll (2) is seated on shaft sections (45) which are provided with spreading elements (44) and can be fastened in the housing (6) via outer bearing journals (46).

17. Dispenser according to claim 1, characterized in that an automatic severing device is provided for the paper (3) which is to be removed, it being possible to adjust the quantity thereof individually.

18. Dispenser according to claim 1, characterized in that a pair of rollers (11, 11') is provided beneath the first roller (7'), and the two are coupled mechanically to one another.

* * * * *